US006199331B1

(12) United States Patent
Hunt

(10) Patent No.: US 6,199,331 B1
(45) Date of Patent: Mar. 13, 2001

(54) HURRICANE FORCE WIND RESISTANCE SLIDING GLASS DOOR ASSEMBLY AND ASSOCIATED METHODS

(75) Inventor: Daniel Hunt, Longwood, FL (US)

(73) Assignee: Robert Hunt Corporation, USA, Longwood, FL (US)

( * ) Notice: Subject to any disclaimer, the term of this patent is extended or adjusted under 35 U.S.C. 154(b) by 0 days.

(21) Appl. No.: 09/298,747

(22) Filed: Apr. 23, 1999

Related U.S. Application Data

(60) Provisional application No. 60/115,223, filed on Jan. 8, 1999.

(51) Int. Cl.[7] ..... E06B 1/04

(52) U.S. Cl. ..... 52/207; 52/656.4; 52/651.7; 49/411; 49/425; 49/504

(58) Field of Search ..... 52/207, 656.4, 52/656.7; 49/409, 411, 425, 504

(56) References Cited

U.S. PATENT DOCUMENTS

| | | | | |
|---|---|---|---|---|
| 618,282 | | 1/1899 | McGuire . | |
| 705,081 | | 8/1902 | Hennessey . | |
| 1,332,989 | * | 3/1920 | Layeux | 49/411 X |
| 1,505,966 | | 8/1924 | Murphy . | |
| 1,820,715 | | 8/1931 | Vance . | |
| 1,920,855 | * | 8/1933 | Gloekler | 49/409 X |
| 2,094,990 | | 10/1937 | Lang . | |
| 2,121,094 | | 6/1938 | Nuding et al. . | |
| 2,847,726 | * | 8/1958 | Frick | 52/207 |
| 2,929,115 | * | 3/1960 | Beckstrom | 49/411 |
| 2,949,647 | | 8/1960 | Migneault et al. . | |
| 3,069,301 | | 12/1962 | Buckley et al. . | |
| 3,111,727 | | 11/1963 | Gerecke . | |
| 3,714,738 | | 2/1973 | Koslow et al. . | |
| 3,787,936 | | 1/1974 | Rystad . | |
| 3,852,916 | * | 12/1974 | Laby | 49/409 |
| 3,896,508 | * | 7/1975 | Doan | 49/409 X |
| 3,900,673 | | 8/1975 | Mattimoe et al. . | |
| 3,916,074 | | 10/1975 | Knackstedt et al. . | |
| 4,020,217 | | 4/1977 | Karasudani et al. . | |
| 4,128,694 | | 12/1978 | Fabel et al. . | |
| 4,404,770 | * | 9/1983 | Markus | 49/409 X |
| 4,455,709 | * | 6/1984 | Zanini | 49/411 X |
| 4,486,980 | | 12/1984 | O'Bar . | |
| 4,514,464 | | 4/1985 | Gomez . | |
| 4,803,808 | | 2/1989 | Greisner . | |
| 4,891,921 | * | 1/1990 | Governale | 52/207 |
| 5,341,600 | * | 8/1994 | Heppner | 52/207 X |
| 5,560,149 | | 10/1996 | Lafevre . | |
| 6,018,916 | * | 2/2000 | Henry | 52/126.1 |

OTHER PUBLICATIONS

Rolscreen Company Drawing No. 0302 "Frame Head Assembly" dated Apr. 4, 1986.
Pella Corp. Drawing No. DS6–8 "Clad Sliding French Doors"dated Dec. 14, 1994.
Pella Corp. Drawing No.OAEZ "Panel Retainer" dated Dec. 12, 1994.

* cited by examiner

*Primary Examiner*—Beth A. Stephan
*Assistant Examiner*—Brian E. Glessner
(74) *Attorney, Agent, or Firm*—Allen, Dyer Doppelt Milbrath & Gilchrist, P.A.

(57) ABSTRACT

A sliding door assembly includes a door frame positioned in a structure opening. The door frame includes a roller track along a bottom portion. A fixed door panel may be positioned in the door frame. A sliding door panel is slidably positioned in the door frame and includes a sliding wood door sash, and a reinforced transparent panel carried by the sliding wood door sash. The sliding door panel further includes at least one roller extending outwardly from a bottom of the sliding wood door sash to engage the roller track. At least one shim or other vertical constraining member is mounted adjacent a top of the sliding door panel for vertically constraining the sliding door panel against upward movement when in a closed position so that the roller remains on the roller track despite hurricane force winds. At least one bracket may be connected to the door frame adjacent the bottom of the sliding door panel to laterally confine the sliding door panel despite hurricane force winds.

27 Claims, 5 Drawing Sheets

HURRICANE FORCE WIND RESISTANCE SLIDING GLASS DOOR ASSEMBLY AND ASSOCIATED METHODS

RELATED APPLICATION

This application is based upon prior filed copending provisional application No. 60/115,223 filed Jan. 8, 1999, the entire disclosure of which is incorporated herein by reference.

FIELD OF THE INVENTION

The present invention relates to building structures, and, more particularly, to a sliding glass door resistant to high winds, such as hurricane force winds.

BACKGROUND OF THE INVENTION

Various windows and glass doors have been developed in an effort to avoid the type of structural damage that may result from high winds, as may be experienced in a hurricane. For example, as a result of the widespread destruction caused by hurricane Andrew, new standards have been proposed in certain southern Florida counties to provide stronger windows and doors to decrease the damage to associated structures during severe storms. The glass used in wind resistant windows and doors is typically a laminated glass panel and includes at least one plastic reinforcing layer and one or more glass layers.

The new standard basically requires that the glass panel of the window or door absorb a first blow from an end of a wood 2×4 (weighing 9 lbs.) striking the center at 34 miles per hour. A second similar blow is directed to a corner area of the glass panel. Consequently, the glass is cracked but a large portion of the glass panel is retained in position to close the opening by a reinforcing plastic layer. Only a relatively small effective opening may be formed in the cracked glass panel by the 2×4 strikes. The window or door is next subjected to a pressure cycling test where positive and negative pressures are applied sequentially. A typical test would be 9,000 cycles of 75 lbs./sq. foot and −80 lbs./sq. foot. Positive indicates that the pressure is greater on the exterior of the window or door, and negative pressure indicates that the pressure on the interior of the window or door is greater. During the pressure cycling testing, the plastic film and glass in the glass panel becomes a sail and can exert relatively large forces on the window or door sash and frame members.

Unfortunately, if the window or glass door fails completely, pressures can be generated internal to the structure that may be sufficiently high to cause damage. For example, a portion or all of the roof may be blown from the structure. High quality windows and glass doors, such as those offered by Pella, for example, typically include a wood frame and wood sash and an exterior aluminum cladding material. The wood frame and sash are especially attractive, and can be shaped and painted to achieve a variety of pleasant designs.

However, the possibility of a wood window or wood glass door failing is further enhanced because the wooden styles and rails of the sash, for example, are typically relatively thin. Thus, the problems with addressing the above mentioned hurricane standards are especially difficult for high quality wood windows and wood glass doors. The respective styles and rails may flex, thereby increasing the wind-induced movement of the already cracked glass panel until the wood styles and rails fail or come completely loose from the structure. Sliding glass doors present an especially difficult challenge because of the relatively large surface area, and typical mounting arrangements of the door panels.

SUMMARY OF THE INVENTION

In view of the foregoing background, it is therefore an object of the present invention to provide a high quality wood sliding glass door assembly that is resistant to hurricane force winds.

It is another object of the invention to provide a method for increasing the resistance of wood sliding glass door assemblies to such winds.

These and other objects, features and advantages in accordance with the present invention are provided by a sliding door assembly including a door frame to be positioned in a structure opening. The door frame preferably includes a roller track extending along a bottom portion. In some embodiments, a fixed door panel may also be positioned in the door frame. The fixed door panel may include a fixed wood door sash, and a reinforced transparent panel carried by the fixed wood door sash. A sliding door panel is slidably positioned in the door frame and includes a sliding wood door sash, and at least one reinforced transparent panel carried by the sliding wood door sash. The sliding door panel further includes at least one roller extending outwardly from a bottom of the sliding wood door sash to engage the roller track.

At least one vertical constraining member, such as a shim, is preferably mounted adjacent a top of the sliding door panel for vertically constraining the sliding door panel against upward movement when in a closed position so that the roller remains engaged with the roller track. The at least one vertical constraining member thus helps to prevent the sliding door panel from coming off the roller tack despite forces generated during pressure cycling that occurs in hurricane force winds.

At least one bracket may be connected to the door frame adjacent the bottom of the sliding door panel to laterally confine the sliding door panel when the sliding door panel is in the closed position. More particularly, in an embodiment where the sliding door panel is outside the fixed door panel, one or two brackets may be provided adjacent the bottom of the sliding door panel on the outside of the structure. The brackets may be placed near the lower rollers which permit the door panel to slide. The one or more brackets prevent the lower portion of the sliding door panel from being forced outwardly from the structure. In other words, the brackets prevent the sliding door panel from jumping the track and being forced clear of a the door opening, thereby subjecting the interior of the dwelling to potentially damaging pressures.

The at least one vertical constraining member may comprise a pair of wedge-shaped shims with one shim secured to the upper edge of the sliding door panel adjacent an upper roller, and the other shim secured to the inside of the door frame. When the two shims engage, the sliding door panel is constrained against upward movement.

In another embodiment of the sliding door assembly, the sliding door panel is on the inside of the structure and the fixed door panel is outside. In this variation, the one or more lower brackets are provided on the inside of the structure. At least one shim may also be provided at the top of the sliding door panel.

Another aspect of the invention relates to making or installing a hurricane force wind resistant sliding door assembly. The method includes the step of positioning a door frame in a structure opening. The door frame preferably includes a roller track extending along a bottom portion of the door frame. The method may further include the steps of positioning a fixed door panel in the door frame, and positioning a sliding door panel in the door frame. The sliding door panel includes a sliding wood door sash and at least one reinforced transparent glass or plastic panel carried by the sliding wood door sash, and at least one roller extending outwardly from a bottom of the sliding wood door sash and engaging the roller track. The method may further include the step of mounting at least one vertical constraining member adjacent a top of the sliding door panel for vertically constraining the sliding door panel against upward movement when in a closed position so that the at least one roller remains engaged on the roller track.

In some embodiments, at least one bracket may be connected to the door frame adjacent the bottom of the sliding door panel to laterally confine the sliding door panel when the sliding door panel is in the closed position. The at least one shim or vertical constraining member also constrain the sliding door panel against upward movement in the embodiments including the one or more brackets.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
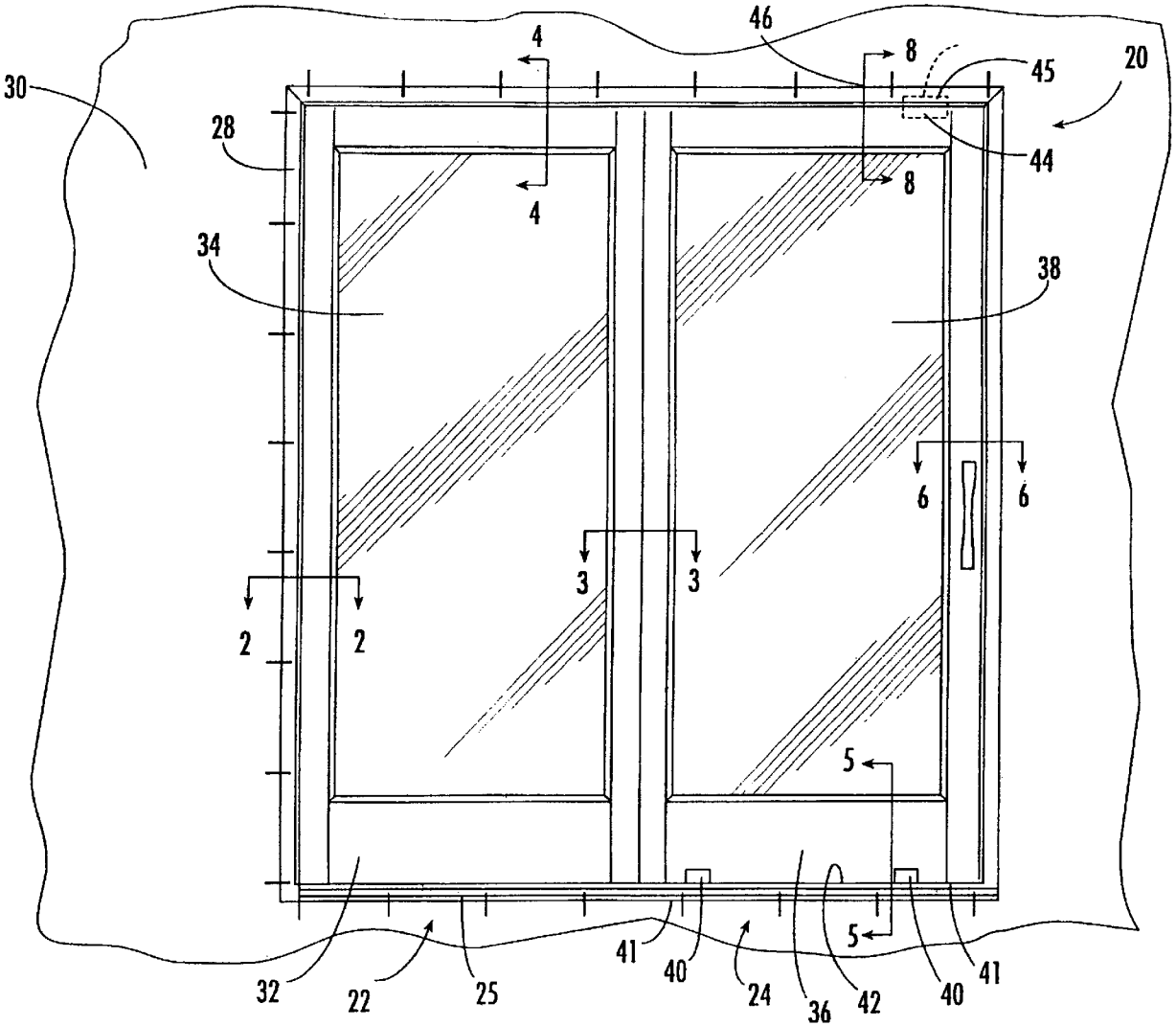
FIG. 1 is a front elevational view of a sliding glass door assembly according to the present invention.
Figure 2:
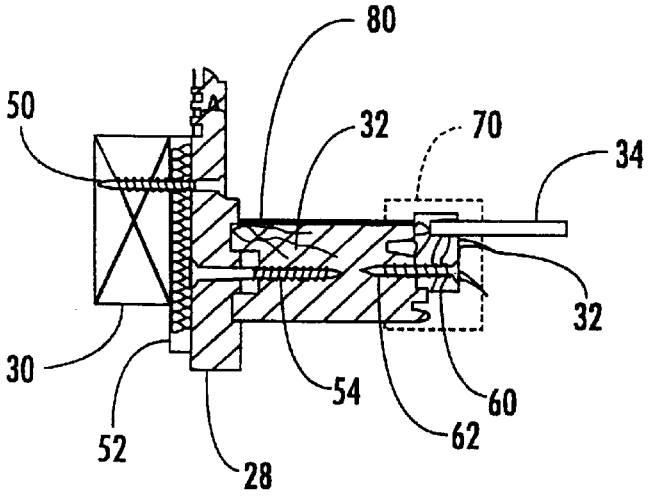
FIG. 2 is a cross-sectional view taken along lines 2—2 of FIG. 1.

Referring initially to FIG. 1, the hurricane force wind resistant sliding door assembly 20 in accordance with the present invention is now described. The illustrated sliding door assembly 20 includes a door frame 28 positioned in an opening of a structure 30. In the illustrated embodiment, a sliding door panel 24 is on the exterior side of the door frame 28, and the fixed door panel 22 is on the interior side. Those skilled in the art will appreciate that the sliding door panel 24 could be on the interior, with the fixed door panel 22 on the exterior. Furthermore, the respective door panels can be configured so that the sliding door panel 24 is on either the right or left hand side. In addition, in other embodiments, two sliding door panels could be provided without any fixed door panel. In addition, an assembly including two sliding door panels, and two fixed door panels is also possible. Those of skill in the art will readily appreciate the various possibilities for sliding door assemblies contemplated by the present invention.

Viewed from the exterior side of the door frame 28, as shown in FIG. 1, the fixed door panel 22 includes a wood door sash 32 and at least one reinforced transparent panel 34 carried by the wood door sash 32. However, in other embodiments, a fixed door panel could be provided without the transparent panel 34.

Figure 7:
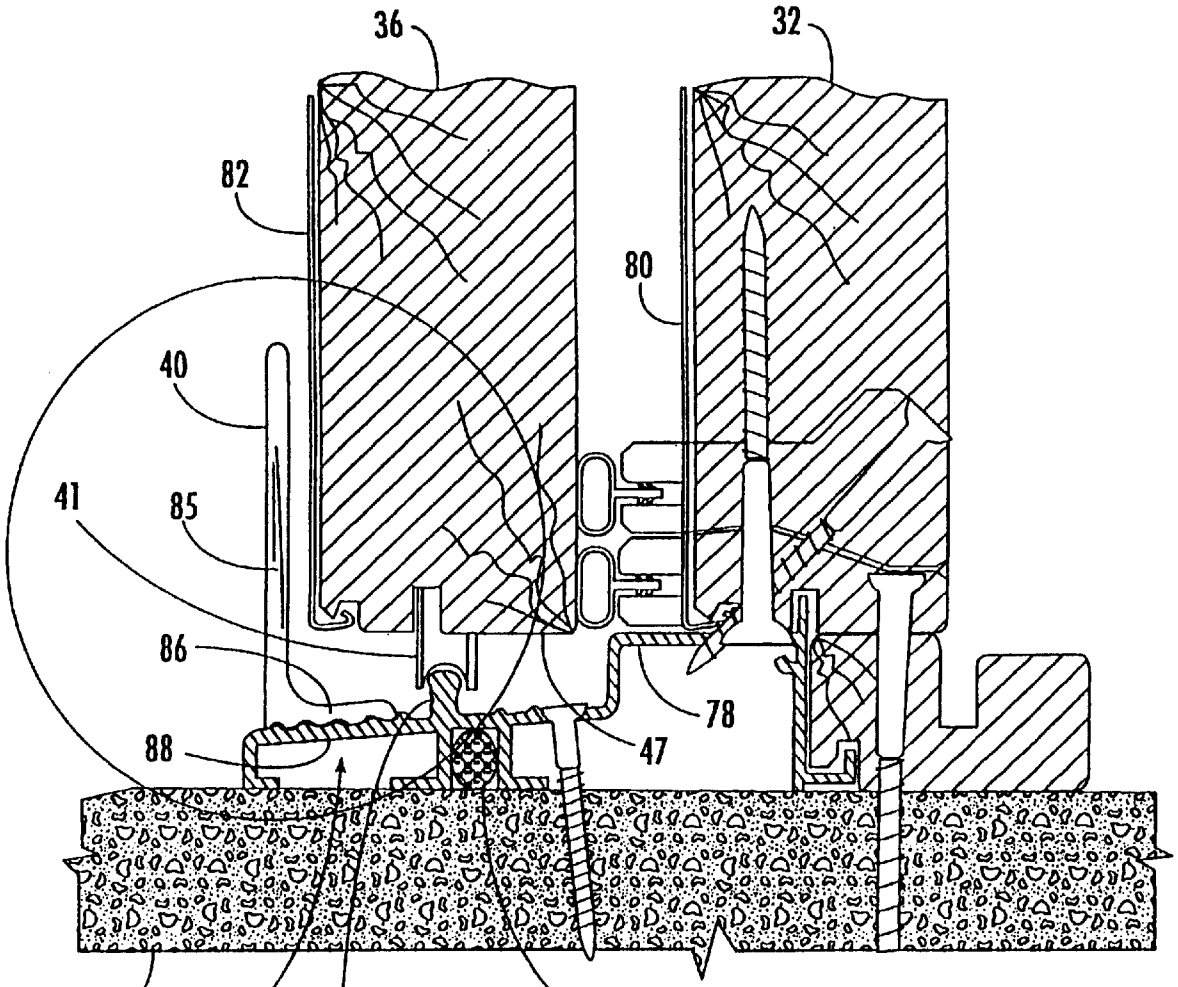
FIG. 7 is an enlarged cross-sectional view similar to FIG. 5.

The sliding door panel 24 includes a wood door sash 36 and at least one reinforced transparent panel 38 carried by the wood door sash. The sliding door panel 24 further includes at least one roller 41, and typically a pair of such rollers, for engaging a roller track 43 within the metal sill 25 of the sliding glass door assembly 20, as best shown in FIG. 7, so that the sliding door panel may be slidably positioned thereon. The metal sill 25 also includes a lower rail 78 extending parallel to the track 43 in spaced apart relation therefrom.

One or more brackets 40 may be connected to the door frame 28 adjacent the bottom 42 of the sliding door panel 24. At least one shim 44 may be mounted adjacent the top 48 of the sliding door panel 24 for constraining the sliding door panel 24 against upward movement when the sliding door panel is in a closed position. As will be explained in more detail herein, the brackets 40, and the shim 44 may cooperate in certain embodiments to prevent the bottom 42 of the sliding door panel 24 from being forced away from the door frame 28 despite forces generated during pressure cycling that occurs in hurricane force winds.

Various sections of the sliding door assembly 29 are further described with reference to FIGS. 2–6. The left and right upright sections, also referred to as jambs, are illustratively mounted within the structure 30 using screws 50, as respectively shown in FIGS. 2 and 6. Insulation 52 may also be positioned between the structure 30 and the door frame 28 to provide an efficient thermal seal around the sliding glass door assembly 20. Those skilled in the art will readily recognize other acceptable methods of securing and insulating the sliding glass door assembly 20 within the structure 30.

In the illustrated embodiment, the door frame 28 is formed from wood. However, other materials are acceptable for forming the door frame 28, such as metal. The fixed wood door sash 32 forming the fixed door panel 22 is mounted in the door frame 28 using screws 54. The reinforced transparent panel 34 is held in place by a glass stop 60 illustratively secured to the wood door sash 32 using screws 62. Of course, an adhesive could be used in other embodiments to secure the glass stop 60 to the wood door sash 32. Similarly, the reinforced transparent panel 38 for the sliding wood door sash 36 forming the sliding door panel 24 is held in place by a glass stop 60 also illustratively secured to the wood door sash 36 using screws 62, although adhesive can be used in other embodiments.

A body of sealant material 70 of a type as will be readily appreciated by those skilled in the art is placed around the edges of the reinforced glass panels 34 and 38. Each of the respective wood door sashes 32, 36 has a groove or cavity for retaining the sealant material 70 when the transparent panels 34, 38 are positioned therein.

An exterior aluminum cladding 80, 82 is attached to the respective wood door sashes 32, 36. The aluminum cladding 80, 82 serves to provide a decorative trim to cover the sealant material 70. The cladding 80, 82 could be formed of other materials, such as vinyl, for example. The exact shape and dimensions of the cladding 80, 82 will vary depending on the particular door design, as will be readily appreciated by those skilled in the art. In other embodiments of the invention, the aluminum cladding is not used, but rather, wood is also on the exterior. Accordingly, the cladding 80, 82 will not be discussed in any detail herein.

The reinforced transparent panels 34, 38 may preferably be a laminated glass including two glass panes 34*a*, 38*a* joined together by a laminating plastic layer 34*b*, 38*b* as would be readily appreciated by those skilled in the art. For example, the glass may be SENTRYGLAS as offered by DuPont. Other impact resistant lanminated glass configurations are also contemplated by the invention. In addition, the reinforced transparent panels 34, 38 may be entirely formed of plastic as will also be readily appreciated by those skilled in the art. The actual number of reinforced transparent panels in a particular door panel may be more than one as will be readily understood by those skilled in the art.

Figure 4:
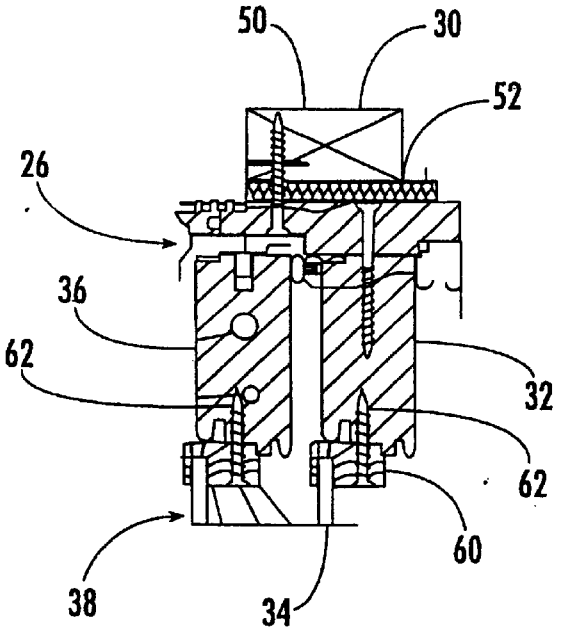
FIG. 4 is a cross-sectional view taken along lines 4—4 of FIG. 1.
Figure 5:
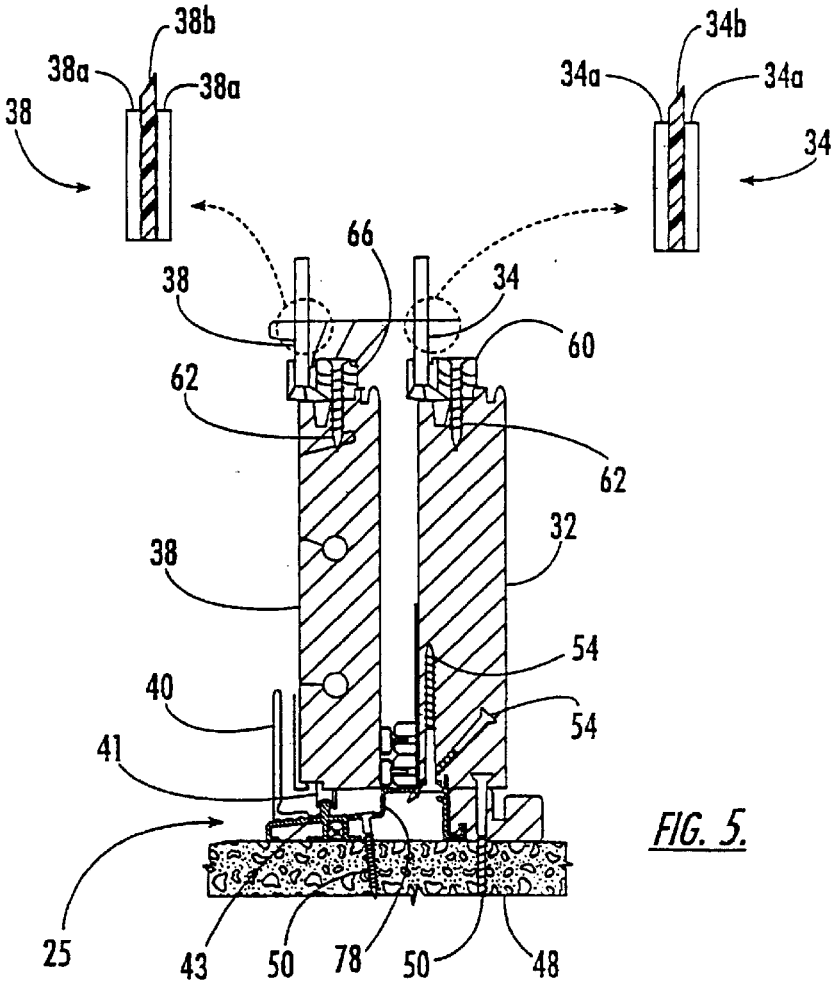
FIG. 5 is a cross-sectional view taken along lines 5—5 of FIG. 1.
Figure 6:
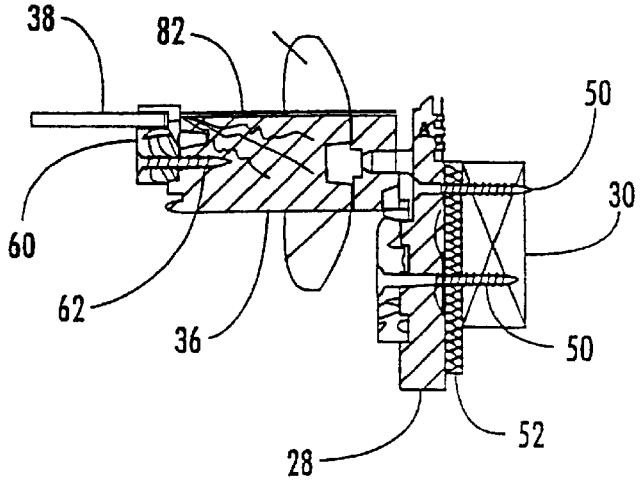
FIG. 6 is a cross-sectional view taken along lines 6—6 of FIG. 1.

The head and sill portions 26, 25 of the sliding door assembly 20 are further described with specific reference to FIGS. 4 and 5. Additional screws 50 are used to secure the door frame 28 to the structure 30. The metal sill 25 may typically be mounted to a concrete slab 48 or foundation. Insulation 52 may also be placed along the head 26 between the structure 30 and the door frame 28.

Additional screws 54 are used to secure the wood door sash 32 to the sill 25. As previously discussed, the sliding door panel 24 includes at least one roller 41 for engaging the roller track 43 for slidably positioning the sliding door panel 24. In the illustrated embodiment, two rollers 41 are provided, as shown in FIG. 1. Accordingly, two brackets 40 may be connected to the door frame 28, with each bracket 40 adjacent a respective roller 41.

Figure 3:
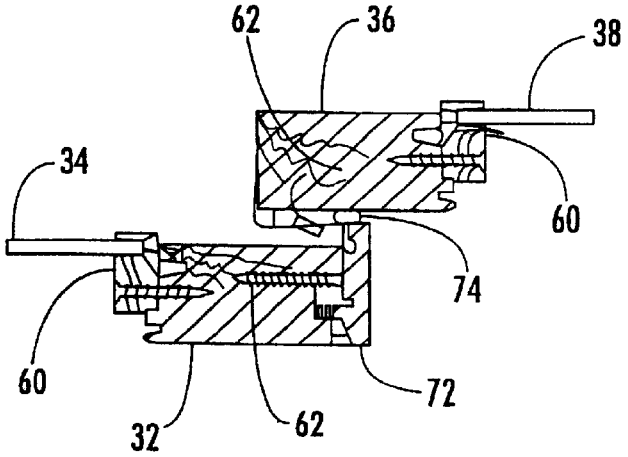
FIG. 3 is a cross-sectional view taken along lines 3—3 of FIG. 1.

The interlocker portion of the sliding glass door assembly 20 is now described with specific reference to FIG. 3. A jamb stop 72 is attached to an edge surface of the fixed wood door sash 32 using screws 62. The jamb stop 72 is formed from wood and abuts weather stripping 74 when the sliding door panel 24 is in a closed position. Additional weather stripping 53 is provided between the sill 25 and the concrete slab 48. Weather stripping 74 is also provided along side the sliding door panel 24.

The rollers 43 extend outwardly from the bottom of the sliding door panel 24 and engage the roller track 43. The shims 44, 45 cause the sliding door panel 24 to be constrained against upward,movement as will be described in greater detail below.

The brackets 40 may be aluminum or other metal, for example, and include a vertically extending portion 85 about 2.5 inches in height from a base portion 86 about 2 inches in width. The base portion 86 is connected to the vertically extending portion 85 to define a generally L-shaped bracket. The bottom surface of the base portion may include recesses which align with corresponding ridges 88 in the sill 25 to thereby provide proper registration. A slight spacing is provided between the brackets 40 and sliding door panel 24 to permit the door to slide as illustrated perhaps best in FIG. 7. The one or more brackets 40 prevent the bottom of the sliding door panel 24 from being forced outwardly from the structure 30.

Figure 8:
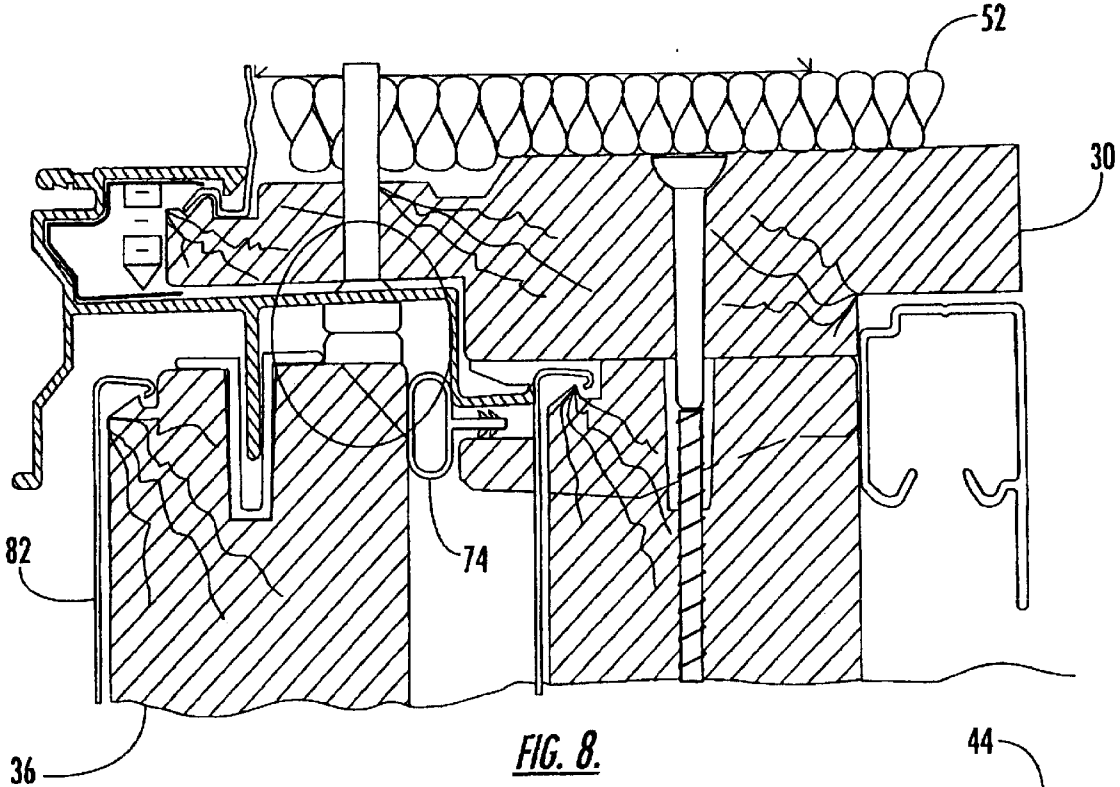
FIG. 8 is an enlarged cross-sectional view taken along lines 8—8 of FIG. 1.
Figure 10:
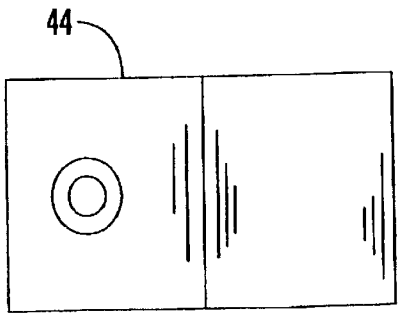
FIG. 10 is a plan view of one of the shims as shown in FIG. 9.
Figure 9:
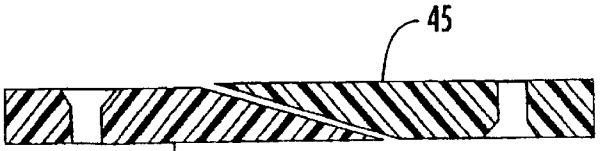
FIG. 9 is an enlarged cross-section view taken through the shims in accordance with the present invention.

The at least one shim 44 may include a pair of wedge-shaped shims 44 and 45, as shown perhaps best in FIGS. 8–10. In one embodiment, the shims 44, 45 are plastic and each have a length of about one to five inches, with a typical length of about 1.5 inches. One of the shims 44 is secured to the upper edge 46 of the sliding door panel 24, and the other shim 45 is secured to the inside of the door frame 28. One skilled in the art will readily recognize other mounting configurations for mounting and engaging the two shims 45, 46 together. When the two shims 44, 45 slidably engage, the sliding door panel 24 is constrained against upward movement to thereby further assist in preventing the sliding door panel 24 from jumping the lower track 43 despite forces generated during pressure cycling that occurs in hurricane force winds.

In addition, those of skill in the art will recognize other vertical constraining means, including one or more vertical constraining members, that are equivalent to the illustrated shims 44, 45. The shims 44, 45 do provide an advantage of relatively smooth operation, based upon sliding engagement, for the sliding door panel 24.

In another embodiment of the sliding door assembly 20, the sliding door panel 24 is on the inside of the door assembly 20 and the fixed door panel 22 is outermost. In this variation, the at least one shim 44 is also preferably mounted adjacent a top of the sliding door panel 24 as discussed above, however, the one or more lower brackets 40 are provided on the inside of the sliding door panel 24.

As will readily be appreciated by those skilled in the art, in some embodiments of the invention, only a bracket in a medial portion of the sliding door assembly 20 need be provided. Accordingly, there is no bracket to interfere with walking through the door opening. In yet other embodiments, the vertical constraining means, such as the shims 44, 45 may be sufficient to retain the sliding door panel 24 within the frame 28 so that no brackets are needed at all.

Another aspect of the invention relates to making or installing a sliding door assembly 20 resistant to hurricane force winds as described above. The method includes the steps of positioning a door frame 28 in an opening of a structure 30. The door frame 28 preferably includes the lower roller track 43. The method further includes the step of positioning a sliding door panel 24 in the door frame 28, and may also include the step of positioning a fixed door panel 22 in the door frame 28. The sliding door panel 24 includes a sliding wood door sash 36 and at least one reinforced transparent panel 38 carried by the sliding wood door sash, and at least one roller 41 extending outwardly from a bottom of the sliding wood door sash and engaging the track 43.

The method may further include the step of mounting at least one shim 44, 45 or other vertical constraining member adjacent a top of the sliding door panel 24 for vertically constraining the sliding door panel against upward movement when in a closed position so that the bottom of the sliding door panel is laterally confined by engagement of the rollers 41 on the roller track 43. At least one bracket 40 may also be connected to the door frame 28 adjacent the bottom of the sliding door panel 24 to laterally confine the sliding door panel when the sliding door panel is in the closed position. Accordingly, the at least one shim 44 and optional brackets serve to prevent the bottom of the sliding door panel 24 from being forced away from the door frame 28 despite forces generated during pressure cycling that occurs in hurricane force winds.

Other related hurricane resistant doors and/or windows are disclosed in copending patent applications filed concurrently herewith entitled HURRICANE FORCE WIND RESISTANT WINDOW OR DOOR WITH AESTHETIC SACRIFICIAL MEMBER AND ASSOCIATED METHODS, and HURRICANE FORCE WIND RESISTANT CASEMENT WINDOW AND ASSOCIATED METHODS, having respective attorney work docket numbers 59543 and 59544, the entire disclosures of which are incorporated herein in their entirety by reference.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That what is claimed:

1. A sliding door assembly resistant to hurricane force winds comprising:

a door frame to be positioned in a structure opening and comprising a roller track extending along a bottom portion;

a fixed door panel positioned in said door frame, and comprising a fixed wood door sash, and at least one reinforced transparent panel carried in said fixed wood door sash;

a sliding door panel slidably positioned in said door frame and comprising a sliding wood door sash and at least one reinforced transparent panel carried in said sliding wood door sash, and at least one roller extending outwardly from a bottom of said sliding wood door sash and engaging said roller track;

first and second wedge-shaped shims mounted adjacent a top of said sliding door panel for slidably enaaging each other when said sliding door panel is moved to a closed position and constraining said sliding door panel against upward movement when in the closed position so that the at least one roller remains engaged on said roller track despite hurricane force winds on said sliding door panel; and at least one bracket connected to said door frame adjacent the bottom of the sliding door panel to laterally confine the sliding door panel against lateral movement when the sliding door panel is in the closed position despite hurricane force winds on said sliding door panel.

2. A sliding door assembly according to claim 1, wherein said at least one bracket is generally L-shaped.

3. A sliding door assembly according to claim 1, wherein said at least one bracket is adjacent said at least one roller.

4. A sliding door assembly according to claim 1, wherein said at least one bracket comprises a plurality of brackets in spaced apart relation.

5. A sliding door assembly according to claim 1, wherein said at least one bracket comprises aluminum.

6. A sliding door assembly according to claim 1, wherein the first shim is mounted on said door frame.

7. A sliding door assembly according to claim 1, wherein the second shim is mounted on said sliding wood door sash.

8. A sliding door assembly according to claim 1, wherein said first and second shims comprise plastic.

9. A sliding door assembly according to claim 1, wherein said at least one reinforced transparent panel comprises at least one glass pane and at least one plastic layer laminated together.

10. A sliding transparent door assembly resistant to hurricane force winds comprising:

a door frame to be positioned in a structure opening and comprising a roller track extending along a bottom portion;

a sliding door panel slidably positioned in said door frame and comprising a sliding wood door sash and at least one reinforced transparent panel carried in said sliding wood door sash, and at least one roller extending outwardly from a bottom of said sliding wood door sash and engaging said roller track; and vertical constraining means adjacent a top of said sliding door panel for constraining said sliding door panel against upward movement when in a closed position so that the at least one roller remains engaged on said roller track despite hurricane force winds on said sliding door panel, said vertical constraining means comprising a first shim carried by said sliding wood door sash and a second shim carried by said door frame, said first and second shims being positioned to engage one another when the sliding door panel is moved to the closed position.

11. A sliding door assembly according to claim 10, further comprising at least one bracket adjacent the bottom of the sliding door panel to laterally confine the sliding door panel against lateral movement when the sliding door panel is in the closed position.

12. A sliding door assembly according to claim 11, wherein said at least one bracket is generally L-shaped.

13. A sliding door assembly according to claim 11, wherein said at least one bracket is adjacent said at least one roller.

14. A sliding door assembly according to claim 11 wherein said at least one bracket comprises a plurality of brackets in spaced apart relation.

15. A sliding door assembly according to claim 11, wherein said at least one bracket comprises aluminum.

16. A sliding door assembly according to claim 10, further comprising a fixed door panel positioned in said door frame.

17. A sliding door assembly according to claim 16, wherein said fixed door panel comprises a fixed wood door sash, and at least one reinforced transparent panel carried by said fixed wood door sash.

18. A sliding door assembly according to claim 10, wherein said first and second shims are wedge-shaped and wherein said first and second wedge-shaped shims slidably engage each other when said sliding door panel is moved to the closed position.

19. A sliding door assembly according to claim 10, wherein said first and second shims comprise plastic.

20. A sliding door assembly according to claim 10, wherein said at least one reinforced transparent panel comprises at least one glass pane and at least one plastic layer laminated together.

21. A method for making a sliding door assembly resistant to hurricane force winds, the method comprising the steps of:

positioning a door frame in a structure opening, the door frame comprising a roller track extending along a bottom portion;

positioning a sliding door panel in the door frame, the sliding door frame comprising a sliding wood door sash and at least one reinforced transparent panel carried by the sliding wood door sash, and at least one roller extending outwardly from a bottom of the sliding wood door sash and engaging the roller track; and positioning a first shim adjacent a top of the sliding wood door sash and a second shim adjacent the door frame so that the first and second shims engage one another when the sliding door panel is moved to the closed position and to vertically constrain the sliding door panel against upward movement and so that the at least one roller remains engaged on the roller track despite hurricane force winds on the sliding door panel.

22. A method according to claim 21, further comprising the step of positioning at least one bracket adjacent the bottom of the sliding door panel to laterally confine the sliding door panel when in a closed position despite hurricane force winds on the sliding door panel.

23. A method according to claim 22, wherein the at least one bracket is generally L-shaped.

24. A method according to claim 22, wherein the at least one bracket is adjacent the at least one biased roller.

25. A method according to claim 22, wherein the at least one bracket comprises a plurality of brackets in spaced apart relation.

26. A method according to claim 21, further comprising the step of positioning a fixed door panel in the door frame.

27. A method according to claim 26, wherein the fixed door panel comprises a fixed wood door sash and at least one reinforced transparent panel carried by the fixed wood door sash.

* * * * *